US011891812B2

(12) United States Patent
Mineo et al.

(10) Patent No.: US 11,891,812 B2
(45) Date of Patent: Feb. 6, 2024

(54) WALLBOARD FASTENING DEVICE WITH GUIDE FLANGE

(71) Applicant: TRUE CORNERS, LLC, Osprey, FL (US)

(72) Inventors: Charles W. Mineo, Ft. Lauderdale, FL (US); Samuel J. Mineo, Osprey, FL (US)

(73) Assignee: TRUE CORNERS, LLC, Osprey, FL (US)

( * ) Notice: Subject to any disclaimer, the term of this patent is extended or adjusted under 35 U.S.C. 154(b) by 0 days.

(21) Appl. No.: 17/662,694

(22) Filed: May 10, 2022

(65) Prior Publication Data

US 2022/0364370 A1 Nov. 17, 2022

Related U.S. Application Data

(60) Provisional application No. 63/189,575, filed on May 17, 2021.

(51) Int. Cl.
*E04F 19/06* (2006.01)
*E04F 13/08* (2006.01)

(52) U.S. Cl.
CPC ..... *E04F 13/0837* (2013.01); *E04F 19/06* (2013.01)

(58) Field of Classification Search
CPC ..... E04F 13/07; E04F 13/076; E04F 13/08; E04F 13/0801; E04F 13/0821;
(Continued)

(56) References Cited

U.S. PATENT DOCUMENTS 479,275 A * 7/1892 Heywood ..... E04D 3/08 52/395
1,129,658 A * 2/1915 Foy ..... E04G 17/14 249/188

(Continued)

FOREIGN PATENT DOCUMENTS

WO 2016034870 A1 3/2016
WO 2020168301 A1 8/2020

OTHER PUBLICATIONS

PCT Application No. PCT/US2022/029571, International Search Report and Written Opinion, dated Aug. 17, 2022.

(Continued)

*Primary Examiner* — Kyle J. Walraed-Sullivan
(74) *Attorney, Agent, or Firm* — COZEN O'CONNOR

(57) ABSTRACT

A wallboard fastening device secures first and second wallboards to a framing member without fasteners passing through the wallboards. The device includes first and second framing panels joined along lengthwise edges at a frame seam to form a two-sided frame that fits around the framing member. The device includes first and second flat-spring flanges joined along lengthwise edges at a front seam. The device includes a channel-dividing panel joined lengthwise to the front seam and to the second framing panel to form first and second channels that are sized to receive edges of the wallboards. The device includes a guide flange joined lengthwise to the frame seam. A corner edge of the second wallboard may be pushed against the guide flange such that the corner edge slides along the guide flange, thereby guiding the second wallboard into the second channel.

20 Claims, 3 Drawing Sheets

(58) Field of Classification Search
CPC ..... E04F 13/0828; E04F 13/0841; E04F 13/0858; E04F 13/0889; E04F 13/0892; E04F 13/21; E04F 13/26; E04F 19/06; E04F 19/062; E04F 19/063; E04F 19/064; E04F 19/065; E04F 19/022
See application file for complete search history.

(56) References Cited

U.S. PATENT DOCUMENTS 2,348,658 A * 5/1944 Slaughter ..... E04F 19/065 52/631
2,379,179 A * 6/1945 Petersen ..... F16B 5/0028 24/336
3,039,232 A * 6/1962 Dunn ..... E04D 3/36 52/204.591
3,374,590 A * 3/1968 Kessler ..... E04F 19/064 52/312
3,445,972 A * 5/1969 Carr ..... E04F 13/0803 52/395
3,485,001 A * 12/1969 Miller ..... E04F 19/06 52/764
3,881,293 A * 5/1975 Conville ..... E04B 9/30 52/285.3
3,989,397 A * 11/1976 Baker ..... F16B 12/02 403/231
4,152,878 A * 5/1979 Balinski ..... E04B 1/941 52/772
4,189,885 A * 2/1980 Fritz ..... E04F 19/06 52/287.1
4,281,494 A * 8/1981 Weinar ..... E04B 2/7411 52/509
4,443,991 A * 4/1984 Mieyal ..... E04B 2/825 52/586.2
4,533,278 A * 8/1985 Corsover ..... E01C 11/10 404/69
4,545,162 A * 10/1985 Attaway ..... E04F 19/06 D25/119
4,553,363 A * 11/1985 Weinar ..... E04F 19/06 52/718.04
4,555,885 A * 12/1985 Raymond ..... E04F 19/065 52/287.1
5,058,333 A * 10/1991 Schwartz ..... E04D 13/0445 52/794.1
5,115,616 A * 5/1992 Nixon ..... E04F 13/0867 52/800.1
5,195,283 A * 3/1993 MacLeod ..... E04F 19/06 52/95
5,245,811 A * 9/1993 Knorr ..... E04B 2/7409 52/243
5,444,953 A * 8/1995 Koenig ..... E04F 13/18 52/282.1
5,729,945 A * 3/1998 Menchetti ..... E04B 2/7453 52/745.12
6,018,924 A * 2/2000 Tamlyn ..... E04F 19/02 52/287.1
6,158,915 A * 12/2000 Kise ..... E04F 19/062 52/774
6,205,733 B1 * 3/2001 LaLonde ..... E04B 9/30 52/506.07
6,209,277 B1 * 4/2001 DiGate ..... E04G 23/0203 52/715
6,311,442 B1 * 11/2001 Watanabe ..... E04F 19/022 52/282.1
6,745,536 B2 * 6/2004 Tallman ..... E04B 9/241 52/506.07
8,061,105 B2 * 11/2011 Haga ..... E04B 2/7457 52/631
8,572,919 B1 * 11/2013 Neill ..... A47G 27/045 52/718.01
8,915,044 B2 * 12/2014 Kline ..... E04F 21/185 248/346.03
9,151,052 B2 * 10/2015 Krause ..... E04F 13/0803
9,631,377 B2 * 4/2017 Browne ..... E04F 19/063
9,663,944 B1 * 5/2017 Lam ..... E04B 2/02
10,483,733 B2 * 11/2019 Cardin ..... H02G 3/0608
10,533,325 B2 * 1/2020 Marinucci ..... E04F 19/062
10,697,183 B1 * 6/2020 Ferguson ..... E04B 1/34321
10,774,551 B1 * 9/2020 Ruiz ..... E04G 23/0207
2002/0116890 A1 * 8/2002 Moore, Jr. ..... E04B 2/8635 52/578
2005/0257461 A1 * 11/2005 Daly ..... E04F 19/064 52/254
2006/0117685 A1 * 6/2006 Kenessey ..... E04F 13/06 52/287.1
2007/0107348 A1 * 5/2007 Browne ..... E04F 19/063 52/417
2007/0163188 A1 * 7/2007 Price ..... E04B 2/7453 52/169.12
2008/0295439 A1 * 12/2008 Janesky ..... E04F 19/06 52/589.1
2009/0056252 A1 * 3/2009 Taylor ..... E04F 19/022 52/287.1
2010/0024339 A1 * 2/2010 Tamlyn ..... E04B 2/7457 52/459
2010/0083599 A1 * 4/2010 Meulemans ..... E04F 19/062 52/287.1
2012/0304568 A1 * 12/2012 Aboukhalil ..... E04F 19/065 52/309.1
2014/0290152 A1 * 10/2014 Morsching ..... E04B 5/00 52/302.1
2016/0040434 A1 * 2/2016 Molteni ..... E04F 13/0828 52/506.05
2018/0251984 A1 * 9/2018 Bodner ..... E04F 19/022
2019/0017280 A1 * 1/2019 Mineo ..... E04F 21/0053
2019/0048598 A1 * 2/2019 Marinucci ..... E04F 19/062
2020/0149270 A1 * 5/2020 Crenshaw ..... E04B 2/78
2022/0120097 A1 * 4/2022 Mineo ..... E04F 19/064
2022/0364370 A1 * 11/2022 Mineo ..... E04F 13/0828
2023/0068997 A1 * 3/2023 Mineo ..... E04F 19/064

OTHER PUBLICATIONS

Clarkdietrich Building Systems, Intertek, SpecDirect, Listing Information of ClarkDietrich Steel 'C-T' Stud and Tabbed 'J' Runner Fire-resistance-rated Shaftwall and Stairwall Wall Assemblies, Spec ID: 26661, dated Sep. 7, 2016. 10 pages.

* cited by examiner

WALLBOARD FASTENING DEVICE WITH GUIDE FLANGE

RELATED APPLICATIONS

This application claims priority to U.S. Provisional Patent Application No. 63/189,575, filed May 17, 2021, which is incorporated herein by reference in its entirety.

BACKGROUND

The goal of a wallboard installation is safe, structurally-sound, durable, and aesthetically-pleasing wall and/or ceiling surfaces in commercial and residential applications.

SUMMARY

The present embodiments include a wallboard fastening device used to secure two adjacent wallboard panels against a framing member in an edge-joint configuration. The wallboard fastening device includes a guide flange that simplifies installation by guiding an edge or corner of a wallboard into a corresponding channel formed by the device. As a result, the guide flange reduces how precisely the wallboard needs to be positioned. This reduced precision advantageously speeds up installation and minimizes damage to the wallboard (such as may be caused when the edge of the wallboard unintentionally hits the framing member).

Wallboard panels are heavy, unwieldy, and somewhat flexible. As a result, it can be difficult to insert a wallboard panel into the channel of a wallboard fastening device (i.e., see the channels 110(1) and 110(2) in FIG. 1) since an edge of the wallboard panel may get caught against the edge of the stud (see stud 206 in FIG. 2) to which the wallboard fastening device is affixed. When the edge gets caught, it may not be possible to push the wallboard panel into the channel without damaging it. The guide flange of the present embodiments advantageously allows the installer to set or lay the edge of the wallboard panel against the guide flange so that it can then be pushed into the channel without catching or getting stuck on the stud.

The present embodiments press against the two adjacent wallboards continuously along the entire length of their edges, advantageously increasing their structural integrity and resistance to shear forces as compared to prior-art installation methods that teach securing a wallboard panel with fasteners placed apart every 16 inches (e.g., as required by some building codes). In fact, the present embodiments do not require any fasteners to pass through the wallboard panels, thereby eliminating the need to cover fastener heads that are visible after fastening with prior-art installation methods. Furthermore, by eliminating fasteners that pass through the wallboard, the present embodiments advantageously avoid several types of installation errors that commonly occur with prior-art methods, such as improperly-installed fasteners that may compromise the strength of the wallboard panel and/or its attachment to the underlying framing member. Examples of improperly-installed fasteners include fasteners of the wrong type, fasteners driven so far into the wallboard panel that they penetrate past the outer paper facing of the wallboard panel, fasteners that are not installed at prescribed distances along the edge of a wallboard panel (e.g., every 16 inches), fasteners that pass too close to an edge of the wallboard panel, and fasteners that are too short to sufficiently penetrate the underlying framing member.

The present embodiments also visibly cover the gap, joint, or seam between two adjacent wallboard panels, advantageously creating a "treated joint" without applying joint tape while avoiding the time-consuming steps of repeated applications of joint compound followed by sanding of each joint compound application. By completely removing joint tape and optionally joint compound, the present embodiments further improve structural integrity by avoiding inadequately- and/or inappropriately-applied joint tape and/or joint compound.

The above examples of installation errors are frequently the result of human error, job shortcuts, and/or improper training of wallboard installers (e.g., contractors, laborers). Thus, the present embodiments speed up installations by simplifying the installation, thereby reducing the number of errors and the amount of skill and training needed for wallboard installers. The embodiments also advantageously reduce waste and cost by minimizing materials (i.e., wallboards, joint tape, joint compound) that must be replaced when an installation error occurs.

In parallel applications of wallboard panels, the present embodiments may advantageously improve fire safety, as compared to prior-art wallboard installation methods, by helping to contain and limit the spread of fire in a building. More specifically, the wallboard fastening device can fully seal the joint formed by two adjacent wallboard panels against an underlying framing member along the entire length of the joint and framing member, thereby completely blocking air flow through the joint so that air cannot flow from the room in front of the wallboards to the region behind the wallboards, and vice versa. In conjunction with flame-retardant materials commonly used in wallboard panels, the present embodiments limit oxygen-fueled growth of a fire, preventing the fire from spreading between rooms (or at least slowing the growth and spread of the fire, thereby buying valuable time for people to escape the building and/or protecting firefighters by reducing the resulting size and/or intensity of the fire).

To achieve what is referred to in the art as a level-5 finish (i.e., the level of finish requiring the most labor and skill, often used in high-end residential construction), a wallboard installer may apply a "skim coat" over the installed wallboard panels and exposed portions of the wallboard fastening device securing the wallboard panels. The skim coat may be applied using joint compound, plaster, or any other approved skim-coat finish material. The skim coat may be applied directly over the seam formed between an edge of the installed wallboard fastening device and the visible side of the corresponding installed wallboard panel. The skim coat thus hides the seams without the need for any joint tape and/or previously applied joint compound, achieving in one day what takes several days with prior-art wallboard installation methods.

DETAILED DESCRIPTION

Figure 1:
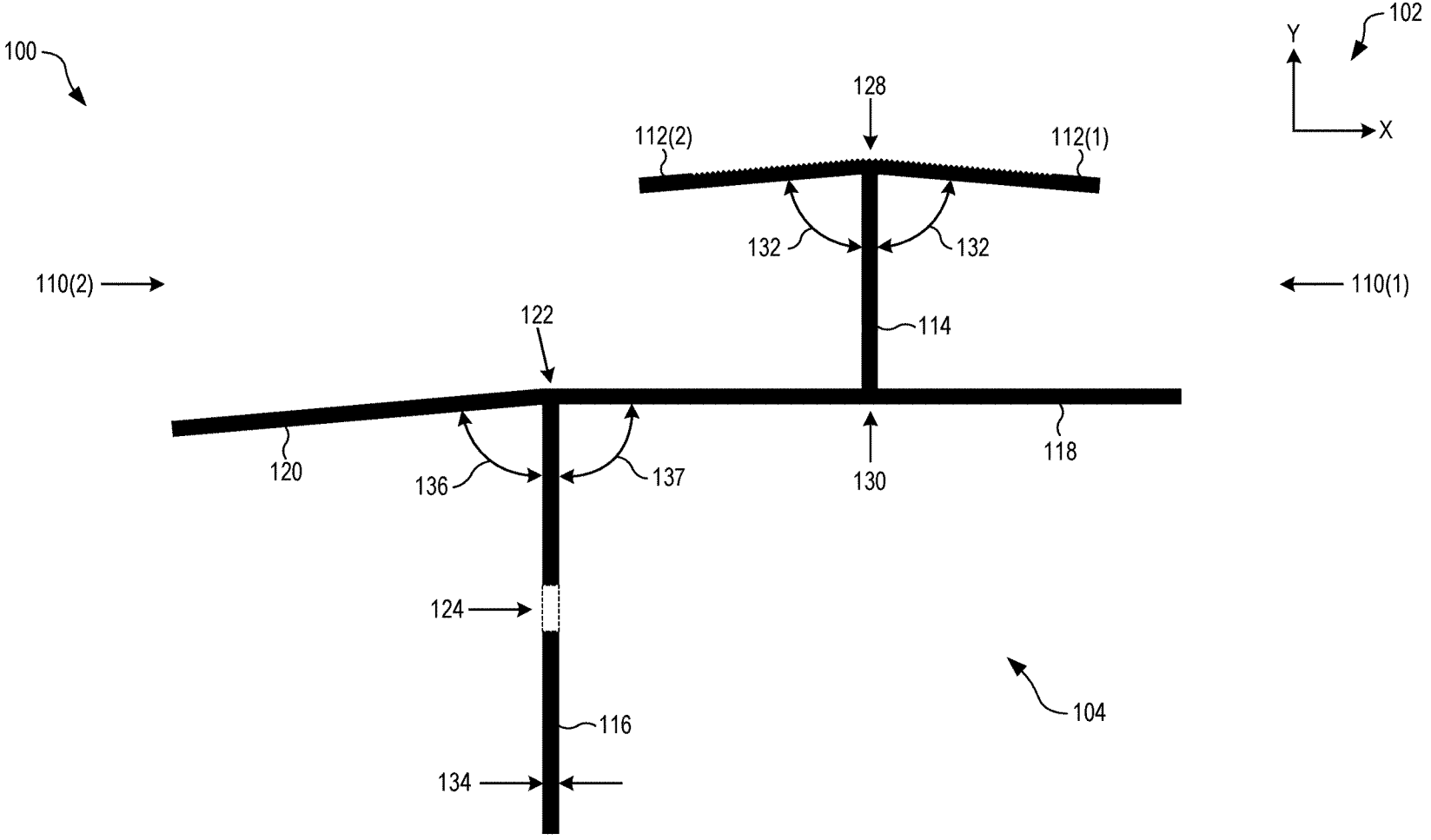
FIG. 1 is a cross-sectional view of a wallboard fastening device that secures wallboards to a framing member in an edge-joint configuration, in an embodiment.
Figure 2:
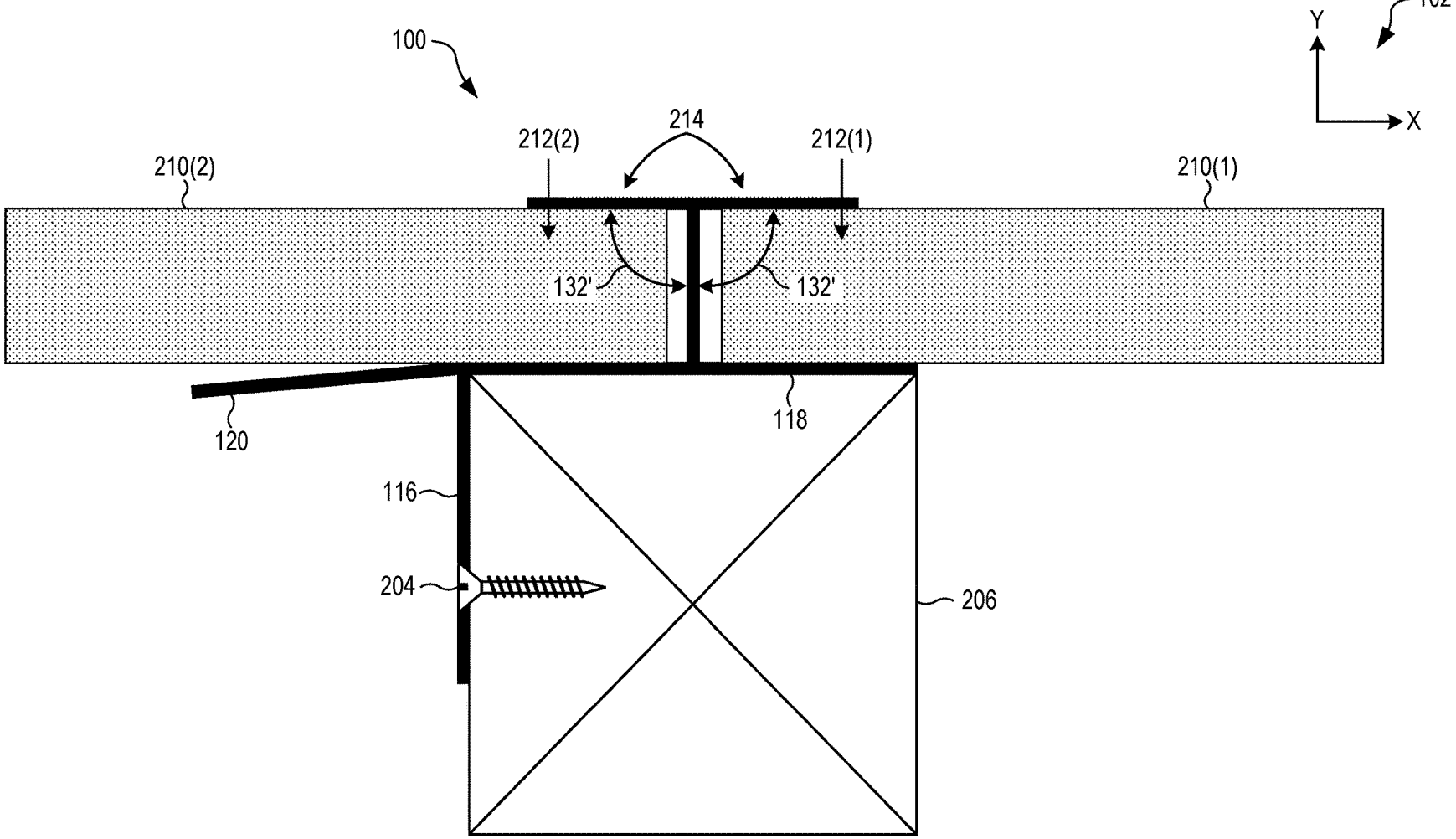
FIG. 2 illustrates the wallboard fastening device of FIG. 1 securing first and second wallboards to a wall stud.

FIG. 1 is a cross-sectional view of a wallboard fastening device 100 that secures wallboards to a framing member in an edge-joint configuration without fasteners passing through the wallboards. FIG. 2 illustrates the wallboard fastening device 100 of FIG. 1 securing a first wallboard 210(1) and a second wallboard 210(2) to a wall stud 206 in the edge-joint configuration. FIGS. 1 and 2 are best viewed together with the following description.

The wallboard fastening device 100 includes a first planar framing panel 116 and a second planar framing panel 118 that are joined along lengthwise edges (i.e., along z; see the right-handed coordinate system 102) to form a two-sided frame 104 that fits around a corner of the wall stud 206. Herein, two components are described as "joined" when they directly connect to each other without any intervening component (e.g., another planar panel). The first framing panel 116 is joined perpendicularly to the second framing panel 118 at a frame seam 122 to form a frame angle 137 therebetween. In FIG. 2, the frame angle 137 is shown as a right angle (i.e., equal to) 90°. However, the frame angle 137 need not be a right angle, provided that the two-sided frame 104 fits around the corner of the wall stud 206.

As shown in FIG. 2, the second framing panel 118 has a width along x that matches a corresponding width of the wall stud 206. However, the second framing panel 118 may alternatively have a width that is greater than, or less than, the width of the wall stud 206 without departing from the scope hereof. Also shown in FIG. 2, a width of the first framing panel 116 in the y direction is less than a depth of the wall stud 206. However, the first framing panel 116 may alternatively have a width that is greater than, or less than, the depth of the wall stud 206 without departing from the scope hereof. Each of the first framing panel 116 and second framing panel 118 may be a solid uniform planar panel free from holes. Alternatively, the first framing panel 116 may form one or more fastener holes 124 through which one or more corresponding fasteners 204 may be inserted to secure the wallboard fastening device 100 to the wall stud 206.

Figure 3:
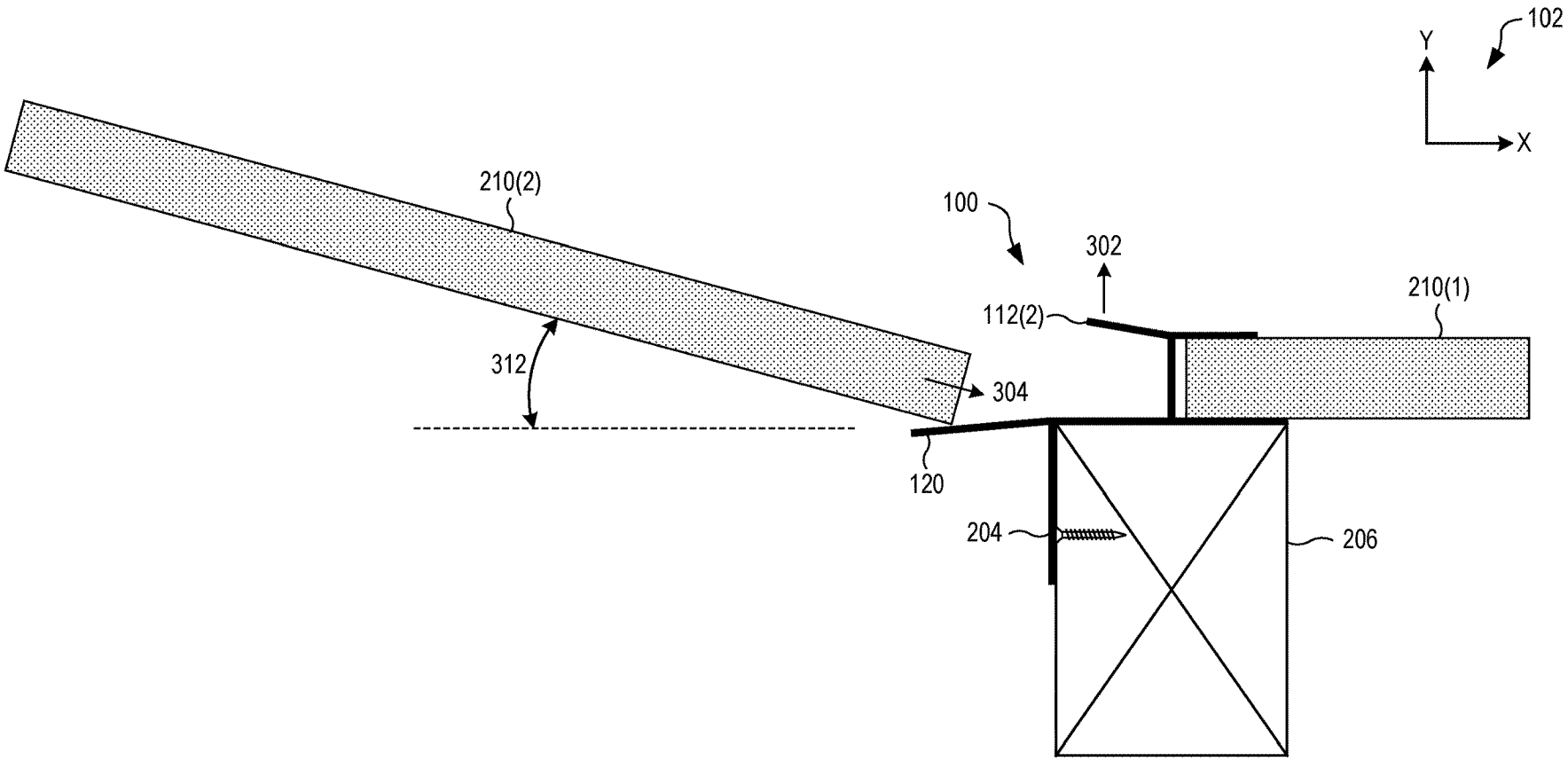
FIG. 3 illustrates how the second wallboard may be installed using the wallboard fastening device of FIG. 1, in an embodiment.

The wallboard fastening device 100 also includes a guide flange 120 the guides the second wallboard 210(2) during installation (see FIG. 3). The guide flange 120 may be a solid uniform planar panel free from holes. A lengthwise edge of the guide flange 120 is joined to the frame seam 122 such that the guide flange 120 forms a guide angle 136 with respect to the first frame panel 116. In FIGS. 1 and 2, the guide angle 136 is shown as 85°. However, the guide angle 136 may have a different value without departing from the scope hereof. Specifically, the guide angle 136 may be right (i.e., equal to 90°), acute (i.e., less than 90°), or obtuse (i.e., greater than 90°).

The wallboard fastening device 100 also includes first and second flat-spring flanges 112(1), 112(2) that are joined along lengthwise edges at a front seam 128. A planar channel-dividing panel 114 is joined lengthwise to the front seam 128 and the second framing panel 118 to form first and second channels 110(1), 110(2). In FIGS. 1 and 2, the channel-dividing panel 114 directly connects to a midline 130 of the second framing panel 118 that is located at a middle of the second framing panel 118 along y. However, the channel-dividing panel 114 may directly connect to the second framing panel 118 at another location (i.e., a different y coordinate). As shown in FIGS. 1 and 2, the channel-dividing panel 114 perpendicularly intersects the second framing panel 118 to form two 90° angles with the second framing panel 118. However, the channel-dividing panel 114 may alternatively intersect the second framing panel 118 to form two complementary angles that are not 90°.

Also shown in FIGS. 1 and 2, a width of the first flat-spring flange 112(1) in the x direction is less than one-half of the width of the second framing panel 118. Similarly, a width of the second flat-spring flange 112(2) in the x direction is less than one-half of the width of the second framing panel 118. However, one or both of the flat-spring flanges 112(1) and 112(2) may have a different width than shown (e.g., greater than one-half of the width of second framing panel 118) without departing from the scope hereof.

The flat-spring flanges 112(1) and 112(2) and the channel-dividing panel 114 are joined along lengthwise edges such that the channel-dividing panel 114 forms, with each flat-spring flange 112, a nominal angle 132 that is less than 90°. For example, the nominal angle 132 may be 85° or 88°. Thus, the flat-spring flanges 112(1) and 112(2) are not parallel to the second framing panel 118 when the wallboards 210(1) and 210(2) are absent (i.e., not inserted into the channels 110(1) and 110(2)). Furthermore, a width of each of the channels 110(1) and 110(2) in the y direction is greatest near the channel-dividing panel 114, and decreases with increasing distance from the channel-dividing panel 114. A width of the channel-dividing panel 114 along y may be selected to match a thickness of the wallboards 210(1) and 210(2) (i.e., in the y direction, as shown in FIG. 2). While FIG. 2 shows the wallboards 210(1) and 210(2) as being untapered, one or both of the wallboards 210(1) and 210(2) may alternatively be tapered.

The first flat-spring flange 112(1) may be flexed to increase the nominal angle 132, thereby opening the first channel 110(1) to facilitate insertion of the first wallboard 210(1) therein. After insertion, the first flat-spring flange 112(1) may be released (i.e., no longer actively flexed by an external force), in which case the first flat-spring flange 112(1) comes to rest against the first wallboard 210(1), exerting a first force 212(1) of sufficient magnitude to push and secure the first wallboard 210(1) against the second framing panel 118. As shown in FIG. 2, the first flat-spring flange 112(1) comes to rest forming a rest angle 132' of approximately 90°. The second flat-spring flange 112(2) behaves similarly to the first flat-spring flange 112(1). At rest, the flat-spring flanges 112(1) and 112(2) are co-planar to each other and parallel to the second framing panel 118, thereby ensuring that the wallboards 210(1) and 210(2) are co-planar with each other.

While FIG. 2 shows each force 212 applied at a mid-point (in the y direction) of the corresponding flat-spring flange 112, it should be appreciated that the forces 212 are distributed along the x direction where the flat-spring flanges 112 physically contact the corresponding wallboards 210. Furthermore, the forces 212 are also distributed along a length (in the z direction) of the wallboard fastening device 100. Therefore, each force 212 is distributed over an area of the corresponding wallboard 210, resulting in a pressure exerted on the corresponding wallboard 210. Similarly, each wallboard 210, due to its corresponding force 212, pushes against the second framing panel 118 over an area, thereby exerting a pressure on the second framing panel 118.

Each flat-spring flange 112 may be considered a spring with a spring constant, wherein each force 212 is a spring restoring force. The spring constant, and thus the magnitude of the spring restoring forces 212, is determined by the geometry of the flat-spring flanges 112 (e.g., thickness and width), the nominal angle 132, and properties (e.g., Young's modulus) of the material forming the wallboard fastening device 100. In the small-angle approximation and assuming the flat-spring flanges 112 are not flexed beyond their elastic limit, the magnitude of the spring restoring forces 212 scales linearly with an angular deviation from the nominal angle.

The material may be plastic, such as PVC plastic, vinyl or another material with which the wallboard fastening device 100 may be manufactured via extrusion. Thus, for a given material, the spring-restoring forces 212 may be selected by choosing an appropriate thickness of the flat-spring flanges 112(1) and 112(2) and an appropriate nominal angle 132.

The selection of the thickness of the flat-spring flanges 112(1) and 112(2) introduces a tradeoff between the magnitude of the spring-restoring forces 212(1) and 212(2) and a distance in the −y direction that outward-facing surfaces 214 of the flat-spring flanges 112(1) and 112(2) protrude relative to the wallboards 210(1) and 210(2). The more that the flat-spring flanges 112(1) and 112(2) protrude away from the wallboards 210(1) and 210(2), the larger the size of a "step" in the y-direction occurring at a distal lengthwise edge of each flat-spring flange 112. Here, the distal lengthwise edge of each flat-spring flange 112 is the lengthwise edge located opposite to the lengthwise edge forming the front seam 128. The distal lengthwise edge of each flat-spring flange 112 may be tapered to provide a more gradual transition between the outward-facing surface 214 of each flat-spring flange 112 and the corresponding wallboard 210.

In FIG. 1, the first framing panel 116 has a thickness 134 along a direction perpendicular to its width. Although not shown in FIG. 1, each of the second framing panel 118, channel-dividing panel 114, guide flange 120, and flat-spring flanges 112(1) and 112(2) has a corresponding thickness. In one embodiment, each of the first framing panel 116, second framing panel 118, channel-dividing panel 114, guide flange 120, and flat-spring flanges 112(1) and 112(2) has a similar thickness (e.g., 1 mm). However, the first framing panel 116, second framing panel 118, channel-dividing panel 114, guide flange 120, and flat-spring flanges 112(1) and 112(2) may alternatively have different thicknesses without departing from the scope hereof.

In one embodiment, the nominal angle 132 is 87.5°, the first framing panel 116 has a width of 30 mm, the second framing panel 118 has a width of 42 mm, each of the flat-spring flanges 112(1) and 112(2) has a width of 15.5 mm (such that together, they span a width of approximately 31 mm in FIG. 2), and the guide flange 120 has a width of 25 mm. Furthermore, the channel-dividing panel 114 has a width of 14.5 mm, such that the width of each channel 110 is also 14.5 mm, slightly larger than the 12.7 mm width of standard ½" drywall sheets. The wallboard fastening device 100 may be made of PVC, vinyl, or another material that can be extruded. When extruded, the first framing panel 116, second framing panel 118, flat-spring flanges 112(1) and 112(2), guide flange 120, and channel-dividing panel 114 may form the wallboard fastening device 100 as a single integral manufacture.

When the first framing panel 116 forms a plurality of fastener holes 124, these fastener holes 124 may be spaced lengthwise. Along z, a length of the wallboard fastening device 100 may be selected to match a corresponding length of the wallboards 210(1) and 210(2). Each flat-spring flange 112 may be a solid uniform planar panel free from holes. As shown in FIGS. 1 and 2, the outward-facing surface 214 may be textured or processed to accept paint and/or a skim coat of joint compound. Alternative, the outward-facing surface 214 may be smooth.

FIG. 3 illustrates how the second wallboard 210(2) may be installed using the wallboard fastening device 100 of FIGS. 1 and 2. In FIG. 3, the first wallboard 210(1) has already been inserted into the first channel 110(1) of the wallboard fastening device 100, and the wallboard fastening device 100 is affixed to the stud 206 with the one or more fasteners 204. A force 302 may be applied to the second flat-spring flange 112(2) to open the second channel 110(2) while the second wallboard 210(2) is pushed into the opened channel 110(2), as indicated by the arrow 304. Note how a corner of the second wallboard 210(2) contacts an outward-facing surface of the guide flange 120. Thus, as the second wallboard 210(2) is pushed, it will slide along the guide flange 120 into the opened channel 110(2). The second wallboard 210(2) is held at an installation angle 312 relative to the plane of the first wallboard 210(1). The installation angle 312 may be between 25 and 30 degrees. However, the installation angle 312 may have another value without departing from the scope hereof.

Although the wallboard fastening device 100 may secure the first wallboard 210(1) to the stud 206 without fasteners 204 passing through the first wallboards 210(1), it may be beneficial to use additional fasteners 204 that directly secure the first wallboard 210(1) to the stud 206 by passing through the first wallboard 210(1) (i.e., in the y direction). A similar argument holds for the second wallboard 210(2).

In other embodiments, the wallboard fastening device 100 of FIGS. 1-3 includes one or more flexible v-springs that implement a control joint. Examples of such v-springs can be found, for example, in FIG. 9 of International Publication Number WO 2020/168301. In other embodiments, the wallboard fastening device 100 of FIGS. 1-3 is sized to implement an edge joint with a double stud. An example of double-stud mounting can be found in FIGS. 11 and 12 of International Publication Number WO 2020/168301.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. A wallboard fastening device for securing first and second wallboards to a framing member, comprising:

a frame comprising first and second framing panels joined lengthwise to each other, the frame being sized to fit against the framing member;

first and second flat-spring flanges joined lengthwise to each other;

a channel-dividing panel having first and second channel-dividing-panel edges, the first channel-dividing-panel edge being joined lengthwise to one or both of the first and second flat-spring flanges, the second channel-dividing-panel edge being joined lengthwise to the second framing panel to divide the second framing panel into first and second portions;

a guide flange having a guide-flange edge joined lengthwise to the second framing panel;

wherein:

the channel-dividing panel, first flat-spring flange, and first portion of the second framing panel form a first channel sized to receive the first wallboard;

the channel-dividing panel, second flat-spring flange, and second portion of the second framing panel form a second channel sized to receive the second wallboard;

the first flat-spring flange flexes, when the first wallboard is inserted into the first channel, to exert a first restoring force that pushes the first wallboard against the first portion of the second framing panel to secure the first wallboard against the first portion of the second framing panel; and the second flat-spring flange flexes, when the second wallboard is inserted into the second channel, to exert a second restoring force that pushes the second wallboard against the second portion of the second framing panel to secure the second wallboard against the second portion of the second framing panel.

2. The wallboard fastening device of claim 1, the guide flange being a planar panel.

3. The wallboard fastening device of claim 1, the guide flange forming an acute angle with the first framing panel.

4. The wallboard fastening device of claim 3, the acute angle being 80° or more.

5. The wallboard fastening device of claim 1, the first framing panel, the second framing panel, the guide flange, the channel-dividing panel, the first flat-spring flange, and the second flat-spring flange having the same thickness.

6. The wallboard fastening device of claim 1, the first framing panel forming a plurality of fastener holes spaced lengthwise along the first framing panel.

7. The wallboard fastening device of claim 1, wherein:

the channel-dividing panel is perpendicular to the second framing panel;

the first flat-spring flange forms, when the first wallboard is absent from the first channel, a first angle with the channel-dividing panel that is less than 90°; and the second flat-spring flange forms, when the second wallboard is absent from the second channel, a second angle with the channel-dividing panel that is less than 90°.

8. The wallboard fastening device of claim 7, each of the first and second angles being between 85° and 88°.

9. The wallboard fastening device of claim 7, wherein:

the first flat-spring flange forms, when the first wallboard is inserted into the first channel, a ninety-degree angle with the channel-dividing panel;

the second flat-spring flange forms, when the second wallboard is inserted into the second channel, a ninety-degree angle with the channel-dividing panel; and the first and second wallboards are co-planar when inserted into the respective first and second channels.

10. The wallboard fastening device of claim 1, the channel-dividing panel being joined lengthwise to a midline of the second framing panel.

11. The wallboard fastening device of claim 10, a width of each of the first and second flat-spring flanges being less than one-half of a width of the second framing panel.

12. The wallboard fastening device of claim 1, being formed from plastic.

13. The wallboard fastening device of claim 1, an outward-facing surface of one or both of the first and second flat-spring flanges being textured.

14. The wallboard fastening device of claim 1, an outward-facing surface of one or both of the first and second flat-spring flanges being not textured.

15. The wallboard fastening device of claim 1, wherein:

the first framing panel has a first framing-panel edge; and the second framing panel has a second framing-panel edge joined lengthwise to the first framing-panel edge.

16. The wallboard fastening device of claim 1, the first and second framing panels being perpendicular to each other such that the frame is shaped to fit against a corner of the framing member.

17. The wallboard fastening device of claim 1, wherein:

the first flat-spring flange has a first flat-spring-flange edge; and the second flat-spring flange has a second flat-spring-flange edge joined lengthwise to the first flat-spring-flange edge.

18. The wallboard fastening device of claim 17, the first channel-dividing-panel edge being joined lengthwise to both the first flat-spring-flange edge and the second flat-spring-flange edge.

19. The wallboard fastening device of claim 1, formed via extrusion.

20. The wallboard fastening device of claim 1, one or more of the second framing panel, first flat-spring flange, and second flat-spring flange is free of holes.

* * * * *